US006700081B1

(12) United States Patent
Houck, III

(10) Patent No.: US 6,700,081 B1
(45) Date of Patent: Mar. 2, 2004

(54) FUSE BLOCK WITH DOOR SENSING ROTARY DISCONNECT

(75) Inventor: Theodore John Houck, III, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/298,326

(22) Filed: Nov. 18, 2002

(51) Int. Cl.[7] ..... H01H 9/20
(52) U.S. Cl. ..... 200/50.07; 200/50.12
(58) Field of Search ..... 200/50.07, 50.1, 200/50.12, 50.01

(56) References Cited

U.S. PATENT DOCUMENTS 1,404,865 A * 1/1922 Kries ..... 200/50.07
1,417,920 A * 5/1922 Jessen ..... 200/50.07
2,053,997 A * 9/1936 Kriek ..... 200/50.07
2,465,079 A * 3/1949 Fitzgerald ..... 200/50.07

* cited by examiner

*Primary Examiner*—Neil Abrams
(74) *Attorney, Agent, or Firm*—Quarles & Brady; Alexander M. Gerasimow

(57) ABSTRACT

A fuse block having a rotary operator communicating with a door-mounted knob provides a sensor arm on the rotary operator for engaging the door handle to detect closure of the door. A slider may actuate a set of plates capturing a swing arm attached to the rotary operator preventing inadvertent movement of the rotary operator when the door is open.

21 Claims, 3 Drawing Sheets

FIG. 2
PRIOR ART
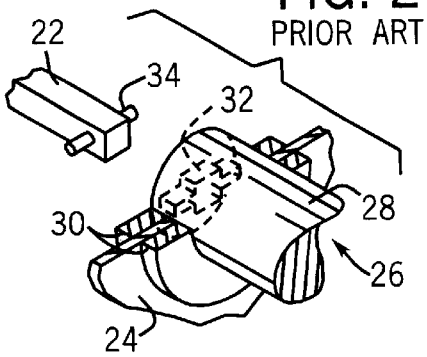
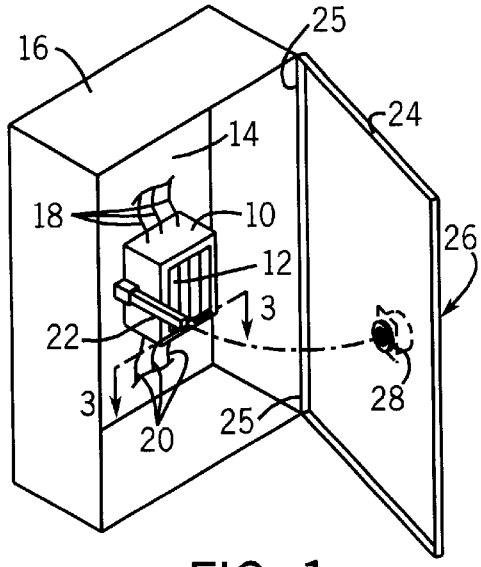
FIG. 1
PRIOR ART
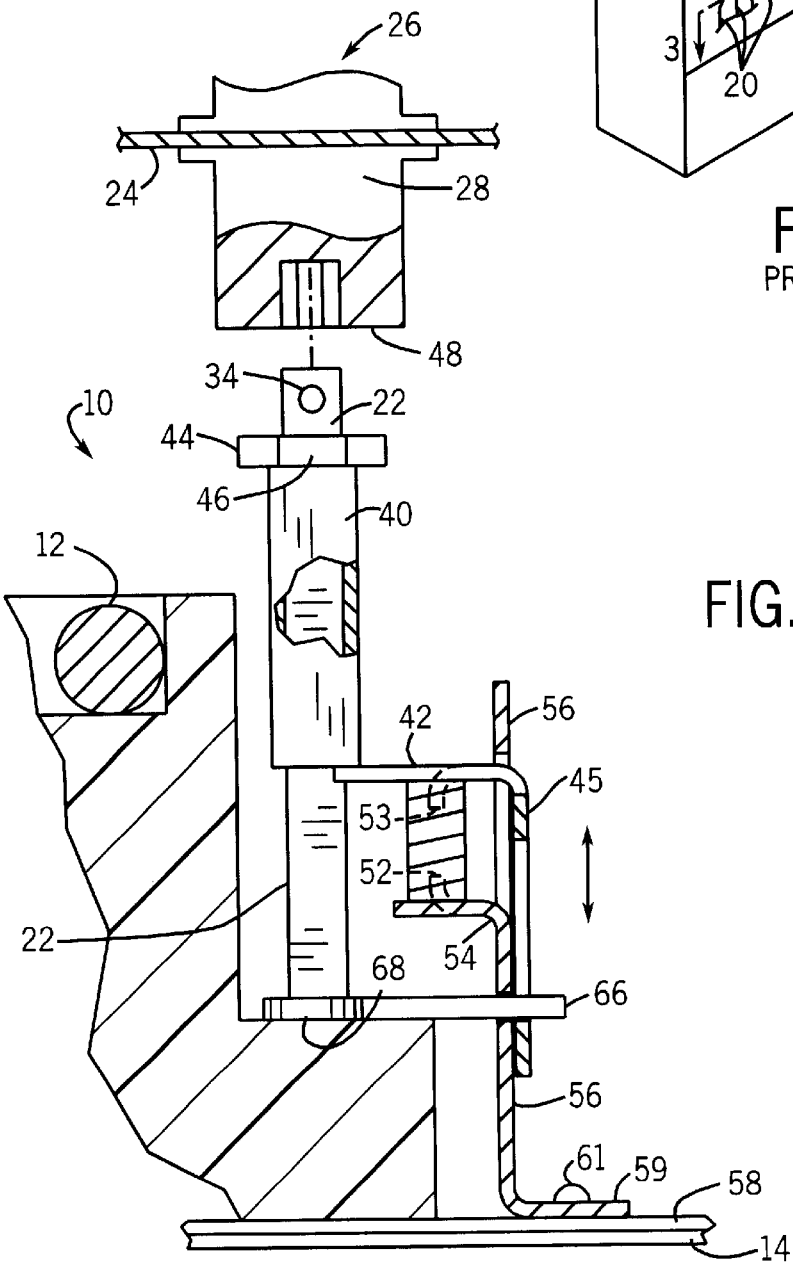
FIG. 3

FUSE BLOCK WITH DOOR SENSING ROTARY DISCONNECT

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to electrical fuse blocks for mounting in cabinets and having a forwardly-extending, rotary disconnect operator that may engage a handle on the cabinet door when the cabinet door is closed, and in particular to an improvement in such a fuse block that reduces the chance of accidental operation of the disconnect operator when the cabinet door is open.

Referring to FIG. 1, a standard fuse block 10 of the prior art may receive fuse cartridges 12 along its front face and may attach at its rear face to the rear wall 14 of a metal cabinet 16.

Input terminals along the top of the fuse block 10 may receive wires 18 which connect independently to one side of each fuse cartridge 12, the latter which interconnect wires 18 to wires 20 attached to output terminals along the bottom of the fuse cartridge 12. The wires 18, for example, may be connected to a source of three-phase power and the wires 20, for example, may be connected to a motor or other piece of equipment.

The fuse block 10 may incorporate a disconnect mechanism (not shown) serving to electrically disconnect the wires 18 from the respective fuse cartridges 12. The disconnect may be controlled by a rotary operator 22 along one side of the fuse block 12 and extending in an orientation perpendicular to the rear wall 14 of the cabinet 16 toward an open face of the cabinet 16.

The open face of the cabinet may be covered by a door 24 attached by hinges to one side of the cabinet 16. The door 24 may support a captively mounted rotary handle 26 having an inwardly extending shaft 28.

Referring now to FIG. 2, the handle 26 may include a shaft 28 extending inwardly through an opening in the door 24 and having retaining flanges 30 for retaining it rotatively within that opening.

When the door 24 is closed about the cabinet 16, the shaft 28 of the handle 26 may engage the outermost end of the rotary operator 22 allowing the rotary operator to be operated by the handle 26 when the door 24 is closed on the cabinet 16. Specifically, an inwardly facing end of the shaft 28 may include a keyway 32 receiving a rectangular end of the rotary operator 22 and a pin 34 extending perpendicularly through the rotary operator. Turning the handle 26, turns the rotary operator 22 electrically disconnecting or connecting power to wires 20.

Referring again to FIG. 1, while the handle 26 allows disconnection of power to wires 20, the door 24 on the cabinet 16 is closed. Once the door 24 is open, power may be inadvertently reconnected by counter rotation of the rotary operator 22 which is how exposed.

BRIEF SUMMARY OF THE INVENTION

The present invention modifies a standard fuse block to allow it to sense the position of the door of the cabinet and lock its disconnect in the open position to prevent inadvertent connection of power when the cabinet door is open. The locking of the disconnect may be manually overridden if it is necessary to reconnect power when the cabinet door is open.

Specifically, the present invention provides a side mounted lockout positioned proximate to the side face of the fuse block and having a sensing arm having a first end positioned near the outer end of the of the fuse block's rotary operator. When the door is closed, the sensing arm is pressed inward by engagement of the outer end rotary operator and the door mounted handle. An operator lock communicates with the sensor arm and the rotary operator to lock rotation of the rotary operator except when the sensing arm is depressed.

Thus, it is one object of the invention to provide a method of locking fuse blocks of this type against inadvertent actuation when the door is open.

It is another object of the invention to provide a locking mechanism that will work with a variety of different cabinet types. Locating the door sensor near the operator, allows the door handle, which necessarily is positioned to engage the rotary operator, to provide the necessary actuation. Modifications to the door or a particular location or orientation of the fuse block within the cabinet are not required so long as the operator of the fuse block properly engages the door handle.

The sensing arm may be a sleeve slidably fitting over the rotary operator.

Thus, it is another object of the invention to provide for a simple sensing mechanism that is fully supported by the sensing arm to be in alignment with the actuating door handle.

The sleeve may include at least one radial extension arm abutting the portion of the door mounted handle when the outer end of the rotary operator is engaged with the portion of the door mounted handle.

Thus, it is another object of the invention to provide a door sensor that works with a variety of different door mounted handles so long as some part of the door handle engages the radial arm.

The radial extension arm may extend over the front face of the fuse block when the rotary operator is rotated to connect power. Conversely, the radial extension arm may extend along the side face of the fuse block and not over the front face when the rotary arm is rotated to disconnect the fuse to the power connections.

Thus it is another object of the invention to provide a visual indication of a connected fuse block, and alternatively, to prevent interference with removal of the fuses by the radial arm when the fuse block is disconnected.

The operator lock may include a collar engaging the rotary operator and having at least one tooth captured by a stop communicating with the sensing arm to be retracted when the sensing arm is depressed inward.

Thus, it is another object of the invention to provide a locking mechanism that may work with existing fuse block designs by engagement of a collar with the normally rectangular shaft of the rotary operator.

The stop may be a slider plate mounted slidably to a support plate fixed with respect to the fuse block, the slider plate sliding along an outwardly extending axis.

It is another object of the invention to provide a locking mechanism that may fit closely adjacent to the fuse block so as not to increase the amount of space required within the cabinet for the fuse block.

The slider plate and mounting plate may have holes sized to receive the shank of a padlock and aligned when the operator is in the position of disconnecting the fuse.

Thus, it is another object of the invention to provide for a positive lockout of the fuse block that cannot be defeated by opening of the cabinet door or manipulating the mechanical operator lock.

These particular objects and advantages may apply to only some embodiments falling within the claims, and thus do not define the scope of the invention.

BRIEF DESCRIPTION OF THE DRAWINGS

FIG. 1 is a perspective view of a prior art fuse block described above and mounted to the rear of a cabinet and having a forwardly extending rotary disconnect operator that may be received by a door mounted handle when the cabinet door is closed;

FIG. 2 is a fragmentary view of the door-mounted handle immediately before engagement with the rotary disconnect operator as known in the prior art;

FIG. 3 is a partial cross-sectional view taken along lines 3—3 of FIG. 1 showing modification of the prior art fuse block by addition of the door sensing arm and operator lock of the present invention, the sensor arm being a sliding collar engaging a shaft of the door handle to communicate with a slider plate on a mounting plate that provide an operator lock;

DETAILED DESCRIPTION OF THE PREFERRED EMBODIMENT

Figure 4A:
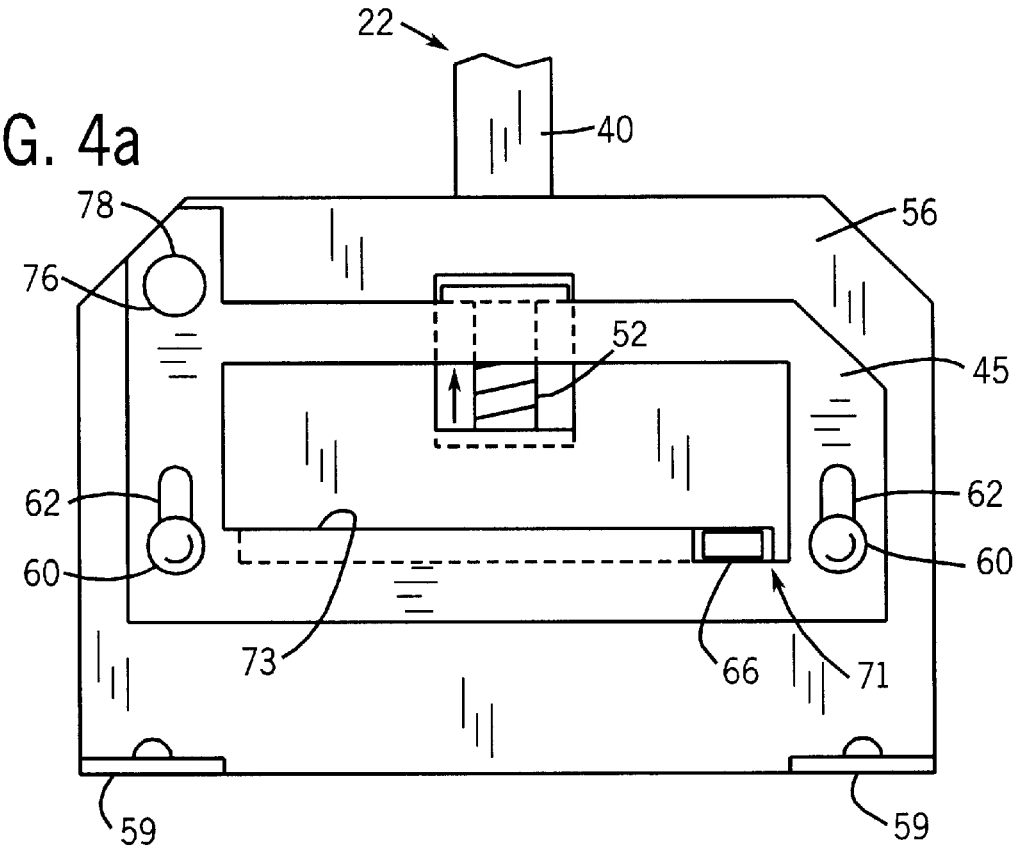
FIG. 4*a* is a side elevational view of the slider plate and mounting plate of FIG. 3 before closing of the door and pressing down of the sensor collar.

Referring now to FIG. 3, the present invention modifies the fuse block 10 described above by placing a tubular sleeve 40 about the rotary operator 22 and beneath the pin 34. The tubular sleeve 40 is sized to move freely up and down the rotary operator 22 limited principally by the pin 34 in upward motion and abutment of the bottom of the tubular sleeve 40 with an activation tab 42 of a slider plate 45 in downward motion, as will be described.

Figure 5:
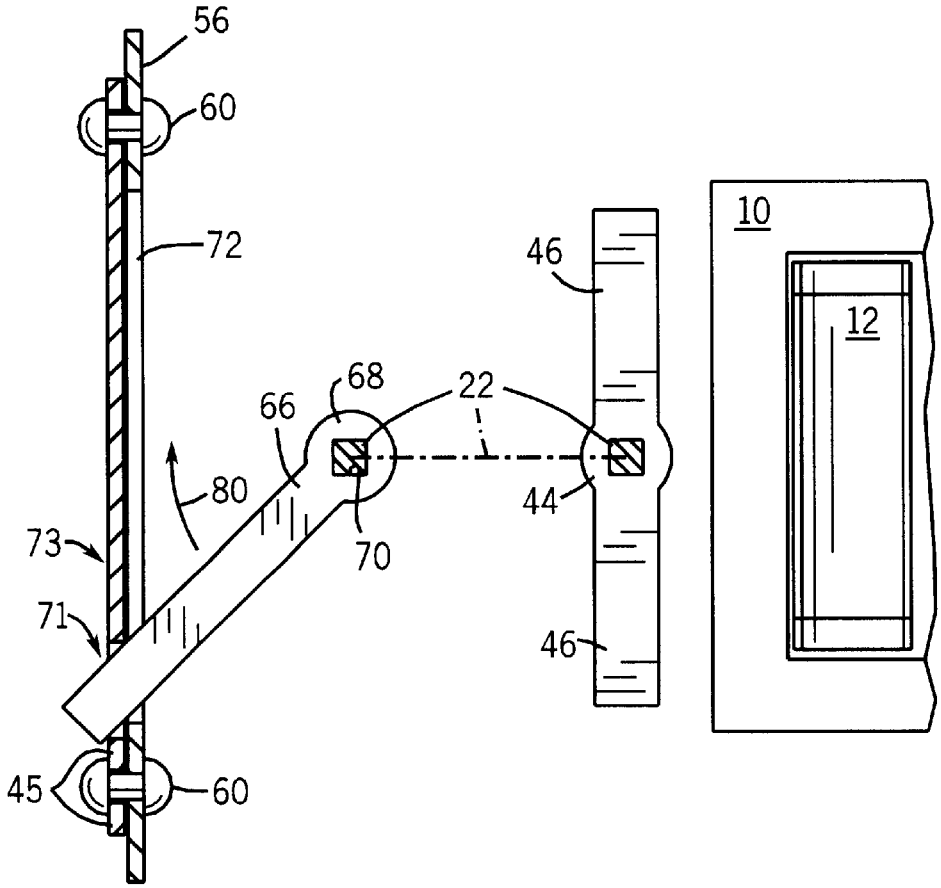
FIG. 5 is an exploded view of a swing arm fit by a collar onto the rotary disconnect operator of FIG. 3 and interacting with the sliding and mounting plates so as to prevent rotation of the rotary disconnect operator, FIG. 5 further showing the position of a radial extension arm engaging with the door handle when the fuse block is in the disconnected state such as allows easy access to the fuse cartridges.

Referring now to FIGS. 3 and 5, the upper end of the tubular sleeve 40 is attached to an engagement collar 44 having two radial extension arms 46. The engagement collar 44 has a square opening fitting closely to the square cross section of the rotary operator 22 so that the engagement collar, radial extension arms, and tubular sleeve 40 rotate with the rotary operator 22 while being free to move up and down along the rotary operator 22.

The engagement collar 44 and radial extension arms 46 are sized to abut an inner face 48 of the shaft 28 of the captive door handle 26 when the door 24 of the cabinet 16 is closed. In this state, the shaft 28 presses down on tubular sleeve 40. When the door 24 is open (as shown in FIG. 3), the tubular sleeve 40 is free to travel upward. The radial extension arms 46 ensure that the shaft 28 will abut the engagement collar 44 for a wide range of handle types and designs.

As mentioned above, the lower end of the rotary operator 22 engages one end of a horizontally extending activation tab 42. The activation tab 42 has contour adjacent to the rotary operator 22 allowing free rotation of the rotary operator 22 while still allowing it to engage the lower end of the sliding tubular sleeve 40.

The activation tab 42 communicates with a vertically mounted slider plate 45 and may be folded out of the same sheet of metal as slider plate 45.

Referring also to FIGS. 4*a* and 5, slider plate 45 is slidably held against the vertical surface of a mounting plate 56 (on a side of the mounting plate away from the fuse block 10) by shoulder rivets 60 affixed to the mounting plate 56 and passing through vertical slots 62 in the slider plate 45. Mounting plate 56 may be mounted to base plate 58 by means of right angle tabs 59 attached to base plate 58 by fasteners 61 such as machine screws or the like. The base plate 58 is coplanar with the base of the fuse block 10 and the rear wall 14 of the cabinet 16 on which the fuse block 10 is installed.

A compression spring 52 is held to the under surface of tab 42 by means of downwardly extending tooth 53 from tab 42. The compression spring 52 is received by a corresponding upwardly extending tooth 54 from mounting plate 56. The compression spring 52 thereby urges the slider plate 45, the activation tab 42, and hence the lower end of the rotary operator 22 upward absent downward pressure from the shaft 28 of the handle 26 on the door 24.

Figure 4B:
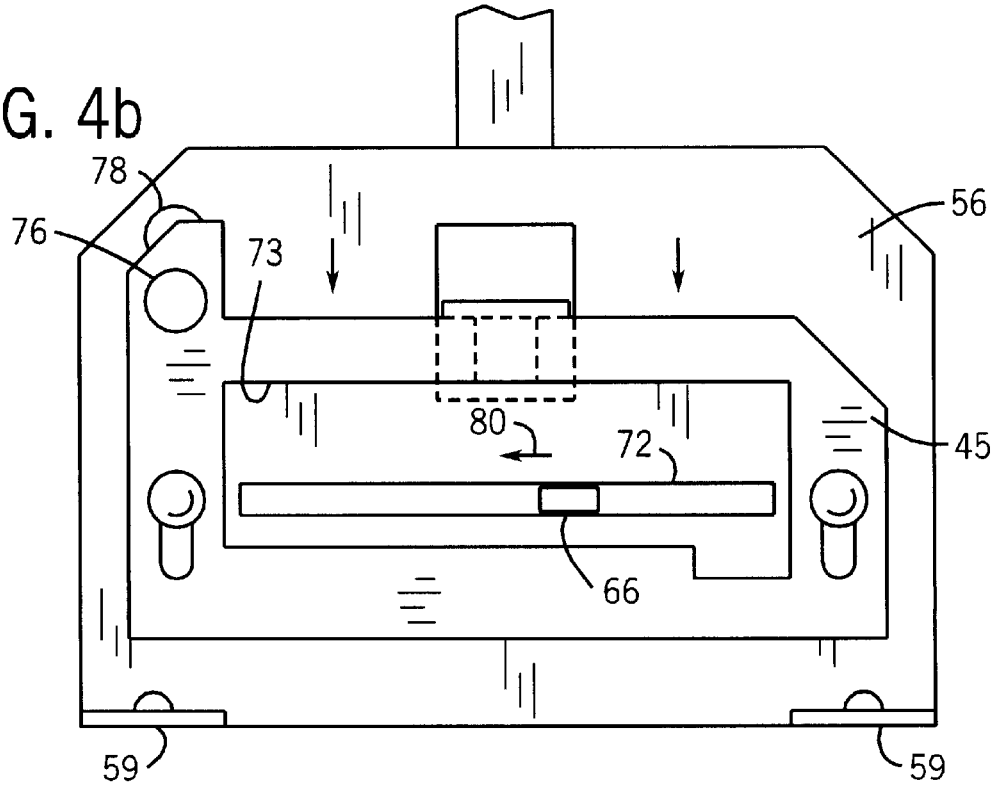
FIG. 4*b* is a figure similar to that of FIG. 4*a* showing movement of the slider plate when the door is closed and the sliding collar is pushed down.

Referring now to FIGS. 4*b* and 5, a swing arm 66 may be attached to the rotary operator 22 beneath the sleeve 40 by means of a collar 68 having a square cutout 70 to engage with the square cross-section of the rotary operator 22. The swing arm 66 attached to the collar 68 extends horizontally through a slot 72 (shown in FIG. 4*b*) in the mounting plate 56, the slot being sufficient in size to allow approximately 90° of rotation of the rotary operator 22 when the collar 68 engages the rotary operator 22. An opening 73 in the slider plate 45 allows the swing arm 66 to also extend through the slider plate 45.

When the rotary operator 22 is in the disconnect position, the swing arm 66 is fully counterclockwise against the right side of the slot 72. In this position, slider plate 45 may be urged upward by the spring 52 to capture an end of the swing arm 66 in a notch 71 in a lower edge of an opening 73 of the slider plate 45. The notch 71 together with the constraint provided by the lower edge of the slot 72 prevents rotation of the rotary operator 22 when the end of swing arm 66 is so captured.

Referring to FIGS. 4*a* and 4*b*, a hole 76 in the slider plate 45 and hole 78 in the mounting plate 56 align when the swing arm is held in the notch 71 of the slider plate 45 so that the slider plate 45 can move upward. Passage of the shank of a padlock through both holes 76 and 78 prevents movement of the slider plate 45 with respect to the mounting plate 56 and thus disengagement of the notch 71 from the end of swing arm 66. Thus, in this location, the swing arm 66 prevents rotation of the rotary operator 22 to reconnect power to the fuse block 10.

Referring now to FIGS. 3 and 4*a*, when the door 24 is in the open position, or slightly before being fully closed, as shown in FIG. 3, the tubular sleeve 40 is biased upward by activation tab 42 which in turn is urged upward by a helical compression spring 52. With further closure of the door, the inner face 48 of the shaft 28 of the door mounted handle 26 presses down on the engagement collar 44 and radial extension arms 46, in turn pushing tubular sleeve 40 downward which engages with activation tab 42 to push slider plate 45 down as shown in FIG. 4*b*.

Referring to FIG. 3, with closure of the door and pushing down of the slider plate 45, slot 72 is uncovered and the end of the swing arm 66 is freed from notch 71. Thus, when the door 24 is fully shut, swing arm 66 is free to move in a clockwise direction 80 as indicated by arrows in FIGS. 4*b* and 5. Movement of the swing arm 66 within the slot 72 allows 90° of clockwise rotation of the rotary operator 22 allowing power to be connected to the fuse block 10.

Referring again to FIG. 5, when the swing arm 66 is in the furthest counterclockwise position, for example, locked by slider plate 45, with power removed from the fuse block 10, the radial extension arms 46 on engagement collar 44 run generally parallel to the proximate edge of the fuse block 10 providing good access to the fuse cartridges 12.

Normally, when the door 24 is open, the swing arm 66 will be as shown in FIG. 5, power will be disconnected from the fuse block 10, and the slider plate 45 will be upwardly engaged with the swing arm 66 as shown in FIG. 4*a*. The locking mechanism may, however, be overridden by pressing down on the tab 42 when the door is open and rotating the collar and radial extension arms 46 to the position shown in FIG. 6.

Figure 6:
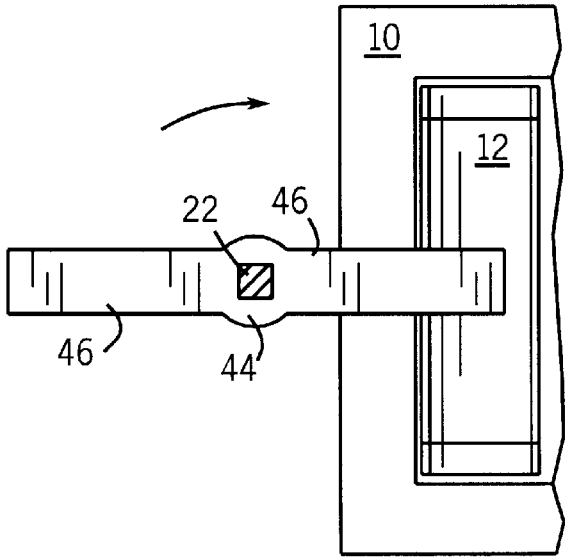
FIG. 6 is a figure similar to that of FIG. 5 showing the rotation of the radial arms when the fuse block is in the connected state and partially obstructing removal of the fuses as a visual indicator that power is connected.

When the swing arm 66 is in the furthest clockwise position, as shown in FIG. 6, with power connected to the fuse block 10, this rotation causes radial extension arms 46 to rotate by 90° and of one of the radial extension arms 46 to extend over part of the fuse block 10 providing a visual indication that it is not appropriate to remove the fuses at this time as power is still connected.

It is specifically intended that the present invention not be limited to the embodiments and illustrations contained herein, but include modified forms of those embodiments including portions of the embodiments and combinations of elements of different embodiments as come within the scope of the following claims.

I claim:

1. An disconnect mechanism for a fuse block receiving power connections and of a type having a support face for mounting on a panel with one or more fuse sockets accessible on a front face of the fuse block opposite the support face and with a rotary operator extending outward along a side face of the fuse block to be substantially perpendicular to a panel on which the fuse block is mounted, an outer end of the rotary operator adapted to receive a portion of a door mounted handle and rotating to disconnect the fuses from the power connections, the improvement comprising:

a side mounted lock out positioned proximate the side face and including:

(a) a sensing arm having a first end positioned near an outer end of the rotary operator to be depressed inward with engagement of the outer end of the rotary operator and the door mounted handle; and (b) an operator lock communicating with the sensing arm and engage the rotary operator to allow rotation of the rotary operator only when the sensing arm is depressed.

2. The disconnect mechanism of claim 1 wherein the sensing arm includes a sleeve slidably fitting over the rotary operator.

3. The disconnect mechanism of claim 2 wherein the sleeve includes at least one radial extension arm abutting the portion of the door mounted handle when the outer end of the rotary operator is engaged with the portion of the door mounted handle.

4. The disconnect mechanism of claim 3 wherein the radial extension arm extends over the front face when the rotary operator is rotated to connect the fuses from the power connections.

5. The disconnect mechanism of claim 3 wherein the radial extension arm extends along the side face and not over the front face when the rotary operator is rotated to disconnect the fuses to the power connections.

6. The disconnect mechanism of claim 1 wherein the operator lock includes a collar engaging the rotary operator and having at least one tooth captured by a stop communicating with the sensing arm to be retracted when the sensing arm is depressed inward.

7. The disconnect mechanism of claim 6 wherein the tooth extends radially from the rotatable operator.

8. The disconnect mechanism of claim 6 wherein the stop includes a slider plate mounted slidably along an outwardly extending axis to a mounting plate fixed with respect to the fuse block, the slider plate providing the stop that is retracted when the sensing arm is depressed inward.

9. The disconnect mechanism of claim 8 wherein the slider plate and mounting plate have padlock holes that must be unaligned for the stop to be retracted.

10. The disconnect mechanism of claim 8 including a biasing spring urging the slider plate outward.

11. The disconnect mechanism of claim 1 including a biasing spring urging the sensor arm outward.

12. A kit for a fuse block receiving power connections and of a type having a support face for mounting on a panel with one or more fuse sockets accessible on a front face of the fuse block opposite the support face and with a rotary operator extending outward along a side face of the fuse block to be substantially perpendicular to a panel on which the fuse block is mounted, an outer end of the rotary operator adapted to receive a portion of a door mounted handle and rotating to disconnect the fuses from the power connections, the kit comprising:

a side mounted lockout attachable to the proximate the side face of the fuse block and including:

(a) a sensing arm having a first end positioned near an outer end of the rotary operator to be depressed inward with engagement of the outer end of the rotary operator and the door mounted handle; and (b) an operator lock communicating with the sensing arm to engage the rotary operator to allow rotation of the rotary operator only when the sensing arm is depressed.

13. The kit of claim 12 wherein the sensing arm includes a sleeve slidably fitting over the rotary operator.

14. The kit of claim 13 wherein the sleeve includes at least one radial extension arm abutting the portion of the door mounted handle when the outer end of the rotary operator is engaged with the portion of the door mounted handle.

15. The kit of claim 14 wherein the radial extension arm extends over the front face when the rotary operator is rotated to disconnect the fuses from the power connections.

16. The kit of claim 14 wherein the radial extension arm extends along the side face and not over the front face when the rotary operator is rotated to connect the fuses to the power connections.

17. The kit of claim 13 wherein the operator lock includes a collar slidably engaging the rotary operator and having a tooth captured by a stop communicating with the sensing arm to be retracted when the sensing arm is depressed inward.

18. The kit of claim 17 wherein the tooth extends radially from the rotatable operator.

19. The kit of claim 17 wherein the stop includes a slider plate mounted slidably along an outwardly extending axis to a mounting plate fixed with respect to the fuse block.

20. The kit of claim 19 including a biasing spring urging the slider plate outward.

21. The kit of claim 12 including a biasing spring urging the sensor arm outward.

* * * * *